US007765639B2

(12) United States Patent
Lee et al.

(10) Patent No.: US 7,765,639 B2
(45) Date of Patent: Aug. 3, 2010

(54) TURBINE BRUSH OF A VACUUM CLEANER

(75) Inventors: Byung-jo Lee, Gwangju (KR); Yun-hee Park, Gwangju (KR); Dong-hun Yoo, Gwangju (KR); Myoung-sun Choung, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 873 days.

(21) Appl. No.: 11/209,613

(22) Filed: Aug. 24, 2005

(65) Prior Publication Data

US 2006/0200935 A1 Sep. 14, 2006

(30) Foreign Application Priority Data

Mar. 10, 2005 (KR) ..... 10-2005-0019963
Apr. 15, 2005 (KR) ..... 10-2005-0031545

(51) Int. Cl.
*A47L 5/10* (2006.01)
*A47L 5/26* (2006.01)

(52) U.S. Cl. ..... 15/387; 15/389

(58) Field of Classification Search ..... 15/387, 15/391, 24, 29, 1.7
See application file for complete search history.

(56) References Cited

U.S. PATENT DOCUMENTS 2,100,089 A 11/1937 Smellie
2,671,926 A * 3/1954 Minerley ..... 15/387
5,375,637 A * 12/1994 Matsumoto et al. .... 144/136.95
6,151,752 A * 11/2000 Melzner et al. ..... 15/387
6,292,970 B1 9/2001 Rief et al.
6,477,735 B2 * 11/2002 Worwag ..... 15/387
2005/0217068 A1 * 10/2005 Kim et al. ..... 15/387

FOREIGN PATENT DOCUMENTS

| | | |
|---|---|---|
| AU | 383264 | 6/1987 |
| DE | 196 02 406 | 1/1997 |
| DE | 19602406 C1 * | 1/1997 |
| DE | 197 51 322 | 5/1998 |
| DE | 100 42 672 | 2/2001 |
| EP | 0 780 085 | 6/1997 |
| GB | 489776 | 8/1938 |
| JP | 06-105772 | 4/1994 |
| KR | 2000-23920 | 1/2000 |
| KR | 2002-0071531 | 9/2002 |
| KR | 20-0370526 | 12/2004 |

OTHER PUBLICATIONS

Korean Intellectual Property Office, Office Action issued Aug. 14, 2006 with respect to Korean Patent Application No. 2005-19963 filed on Mar. 10, 2005.

* cited by examiner

*Primary Examiner*—Bryan R Muller
(74) *Attorney, Agent, or Firm*—Blank Rome LLP

(57) ABSTRACT

A turbine brush for a vacuum cleaner according to an embodiment of the present invention, comprises a turbine brush body connected to a cleaner body in which a suction force is generated and having a suction path therein, a brush member rotatably mounted to the turbine brush body, a driving unit rotatably mounted in the turbine brush body to drive the brush member, and an inertia member for adding inertia to a driving force of the driving unit. Accordingly, a rotative force is not deteriorated even by small particles such as fine dust and hair, owing to the inertia added to the turbine, thereby improving a cleaning efficiency.

12 Claims, 8 Drawing Sheets

TURBINE BRUSH OF A VACUUM CLEANER

CROSS-REFERENCE TO RELATED APPLICATIONS

This application claims benefit under 35 U.S.C. §119(a) of Korean Patent Application Nos. 2005-19963 and 2005-31545, filed Mar. 10, 2005 and Apr. 15, 2005, the entire contents of which are incorporated herein by reference.

BACKGROUND OF THE INVENTION

1. Field of the Invention

The present invention relates to a vacuum cleaner. More particularly, the present invention relates to a turbine brush of a vacuum cleaner, rotated by a turbine to remove impurities on a surface being cleaned.

2. Description of the Related Art

In general, vacuum cleaners comprise a brush member for drawing in dust on a surface being cleaned in contact with the surface being cleaned. Moving along the surface being cleaned, the brush member scratches or beats the surface being cleaned by a rotative force, thereby separating the dust from the surface being cleaned. The separated dust is drawn into a main body of the vacuum cleaner by a suction force generated in the main body.

The brush member is supplied with a rotative force through a dedicated driving motor or a turbine unit. Here, the driving motor is mounted in connection with the brush member to selectively supply the rotative force to the brush member. However, such connection between the driving motor and the brush member causes a complicated structure and increases the manufacturing cost. Therefore, recently, a turbine unit has been widely used in rotating the brush member.

In the structure employing the turbine unit to rotate the brush member, a turbine unit is mounted on a suction path through which the dust is drawn in by the suction force generated in the main body. The turbine unit is rotated by air which is drawn in through the suction path, and the rotative force is supplied to the brush member through a belt. Accordingly, the brush member draws in the dust, rotating in contact with the surface being cleaned.

However, when the turbine unit is used to rotate the brush member, the dust drawn in through the suction path may be caught in the turbine unit. Especially, when small particles such as hair and fine dust are caught in the turbine unit, the rotative force of the turbine unit may be decreased due to low inertia and low torque of the turbine unit.

Accordingly, the rotative force of the brush member connected with the turbine unit is affected, thereby deteriorating a cleaning efficiency.

SUMMARY OF THE INVENTION

An aspect of the present invention is to solve at least the above problems and/or disadvantages and to provide at least the advantages described below. Accordingly, an aspect of the present invention is to provide a turbine brush for a vacuum cleaner, improved in a rotative force for driving a brush member.

In order to achieve the above-described aspects of the present invention, there is provided a turbine brush for a vacuum cleaner, comprising a turbine brush body connected to a cleaner body in which a suction force is generated and having a suction path therein, a brush member rotatably mounted to the turbine brush body, a driving unit rotatably mounted in the turbine brush body to drive the brush member, and an inertia member for adding inertia to a driving force of the driving unit.

According to the first embodiment of the present invention, the driving unit may comprise a turbine rotated by air drawn in through the suction path and having a plurality of blades; a turbine shaft disposed at a rotational center of the turbine; and a power transmitter for conveying a rotative force of the turbine to the brush member.

At least one inertia member may be mounted to the turbine and rotated together with the turbine.

The inertia member may comprise a hook for engagement with a hook hole formed on opposite ends of the turbine.

The inertia member may have an annular shape and fixed in tight contact with opposite sides of the inner circumference of the turbine.

One or more blade of the plurality of blades may have a thickness-varying portion in a direction of a radius.

An arc of the blade may be uneven in a spiral direction at an opposite surface of a surface encountering a resistance of the drawn air.

The blade may have a thicker distal end.

The thickness of the blade increases as further away from the rotational center. An end of the blade may be uneven at an opposite surface of a surface encountering a resistance of the drawn air.

The power transmitter may include a timing belt connecting the turbine shaft and the brush member to transmit power.

The driving unit may be disposed on the suction path in the turbine brush body.

According to another aspect of the present invention, there is provided a turbine brush for a vacuum cleaner, comprising: a turbine brush body connected to a cleaner body in which a suction force is generated and having a suction path therein; a brush member rotatably mounted to the turbine brush body; and a turbine rotatively mounted in the turbine brush body to drive the brush member and having a plurality of blades rotated by air drawn in through the suction path; wherein one or more of the plurality of blades has a thickness-varying portion in a direction of a radius.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
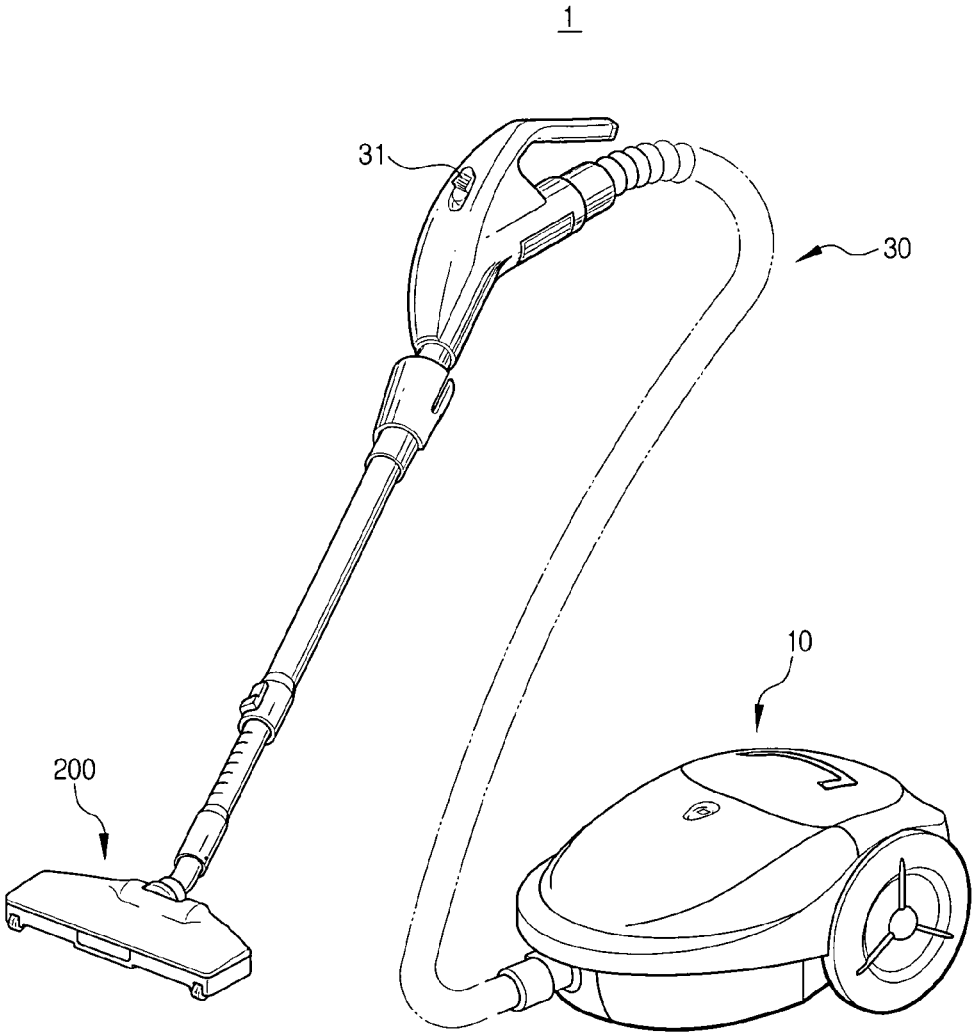
FIG. 1 is a perspective view of a vacuum cleaner employing a turbine brush according to the first embodiment of the present invention.

Hereinafter, an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

FIG. 1 is a perspective view of a vacuum cleaner employing a turbine brush according to the first embodiment of the present invention.

Referring to FIG. 1, the vacuum cleaner 1 comprises a cleaner body 10 including a vacuum generator (not shown) and a dust collecting chamber (not shown), a turbine brush 200 for drawing in dust from a surface being cleaned, and a connection member 30 for connecting the cleaner body 10 and the turbine brush 200. The connection member 30 comprises an operation switch 31 for turning on and off the vacuum cleaner 1.

The vacuum generator (not shown) generates a suction force for drawing in the dust separated from the surface being cleaned. General driving motors can be applied for the vacuum generator. The dust collecting chamber (not shown) collects therein the dust drawn in by the suction force of the vacuum generator.

Figure 2:
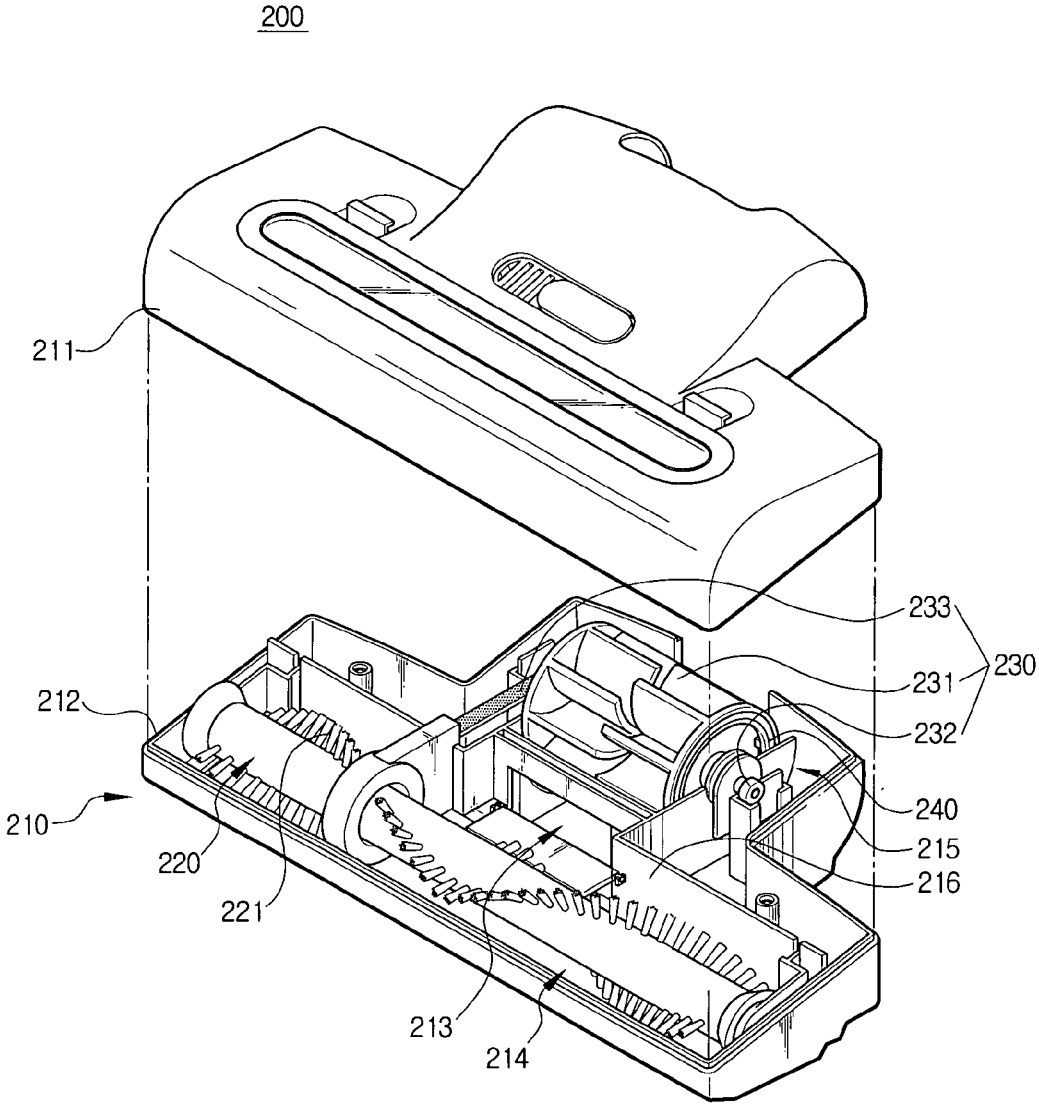
FIG. 2 is an exploded, perspective view of the turbine brush of FIG. 1.

As shown in FIG. 2, the turbine brush 200 comprises a turbine brush body 210, a brush member 220, a driving unit 230 and an inertia member 240.

The turbine brush body 210 is connected to the cleaner body 10 through the connection member 30 to be transmitted with the suction force from the vacuum generator. The turbine brush body 210 comprises upper and lower frames 211 and 212, a suction path 213, a brush member receiving portion 214, and a driving unit receiving portion 215.

The upper and the lower frames 211 and 212 are connected to face each other, thereby constituting an exterior of the turbine brush body 210. The lower frame 212 has a suction opening (not shown) for drawing in external air from the surface being cleaned.

The suction path 213 is formed for the dust drawn in from the surface being cleaned to move to the connection member 30. For this, the suction path 213 provides fluid connection between the brush member receiving portion 214 and the driving unit receiving portion 215, such that the drawn-in dust is guided into the dust collecting chamber of the cleaner body 10 sequentially passing through the brush member 220, the driving unit 230 and the connection member 30.

More specifically, the brush member receiving portion 214 is fluidly connected to the suction opening that draws in the external air by the suction force. The driving unit receiving portion 215 is fluidly connected to the connection member 30, such that the dust drawn in through the suction opening and moved along the brush member 220 and the suction path 213 is guided to the connection member 30. The brush member receiving portion 214 and the driving unit receiving portion 215 are sectioned by a partition 216 formed at the lower frame 212.

The brush member 220 is rotatably mounted to the turbine brush body 210. To this end, the brush member 220 is received in the brush member receiving portion 214 and rotatably supported by the turbine brush body 210 with both ends thereof. A plurality of bristles 221 are implanted at certain intervals along an outer circumference of the brush member 220, and the bristles 221 are exposed to the outside through the suction opening.

Rotating together with the brush member 220, the bristles 221 scratch or beat the dust on the surface being cleaned, thereby separating the dust from the surface being cleaned. The separated dust is drawn in through by the suction force generated in the cleaner body 10 and guided into the dust collecting chamber.

Although the bristles 221 of this embodiment are illustrated in a spiral form symmetrically implanted with respect to a center portion of the outer circumference of the brush member 220, the present invention is not limited so. For example, the bristles 221 may be formed parallel with an axial direction of the brush member 220 at certain intervals. That is, the bristles 221 can be formed in any various types capable of separating the dust from the surface being cleaned.

The driving unit 230 is rotatably mounted to the driving unit receiving portion 215 which is provided on the suction path 213 in the turbine brush body 210, so as to drive the brush member 220. For this, the driving unit 230 comprises a turbine 231, a turbine shaft 232 and a power transmitter 233.

The turbine 231 is rotated by the air which is drawn in through the suction path 213 by the suction force generated from the vacuum generator. The turbine 231 comprises a plurality of blades 234 inwardly protruded from opposite ends of the turbine 231. More preferably, the blades 234 formed from the opposite ends are alternately disposed, such that the turbine 231 can be rapidly rotated by the air drawn in along the suction path 213.

The turbine shaft 232 is inserted in a rotational center of the turbine 231 and supported by the lower frame 212 with opposite ends thereof, such that the turbine 231 is rotatably supported by the turbine brush body 210.

The power transmitter 233 conveys a rotative force of the turbine 231 to the brush member 220. Preferably, a timing belt connecting the brush member 220 and the turbine shaft 232 of the turbine 231 is used for the power transmitter 233.

Figure 3:
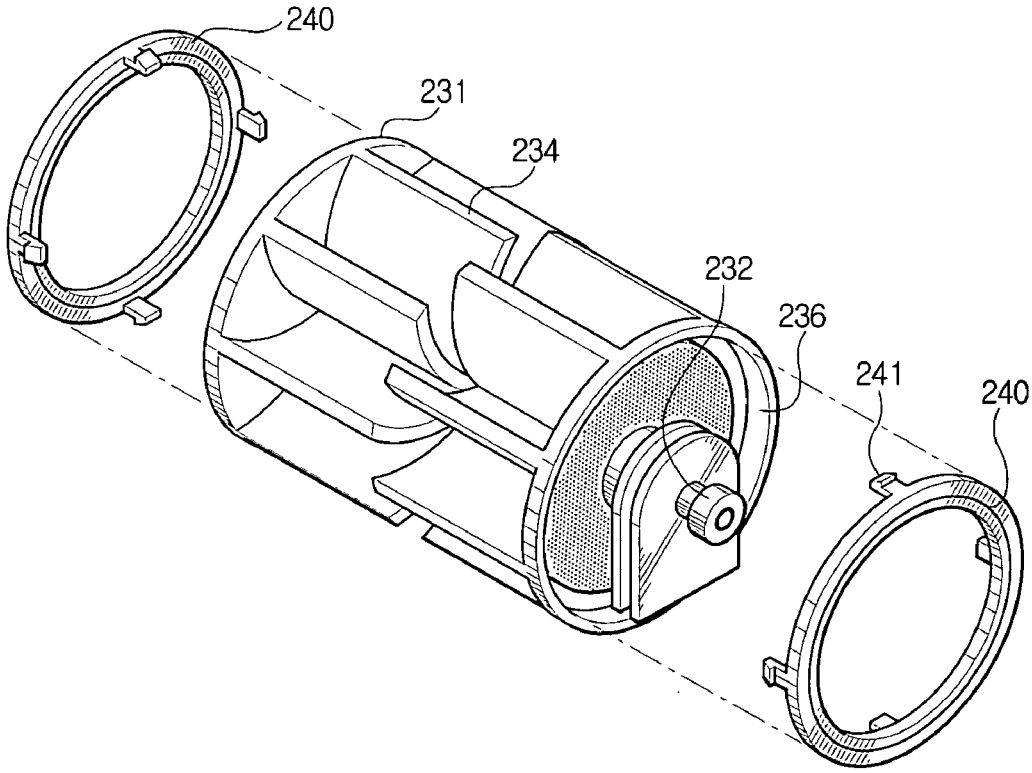
FIG. 3 is an exploded, perspective view of a driving unit of FIG. 2.
Figure 4:
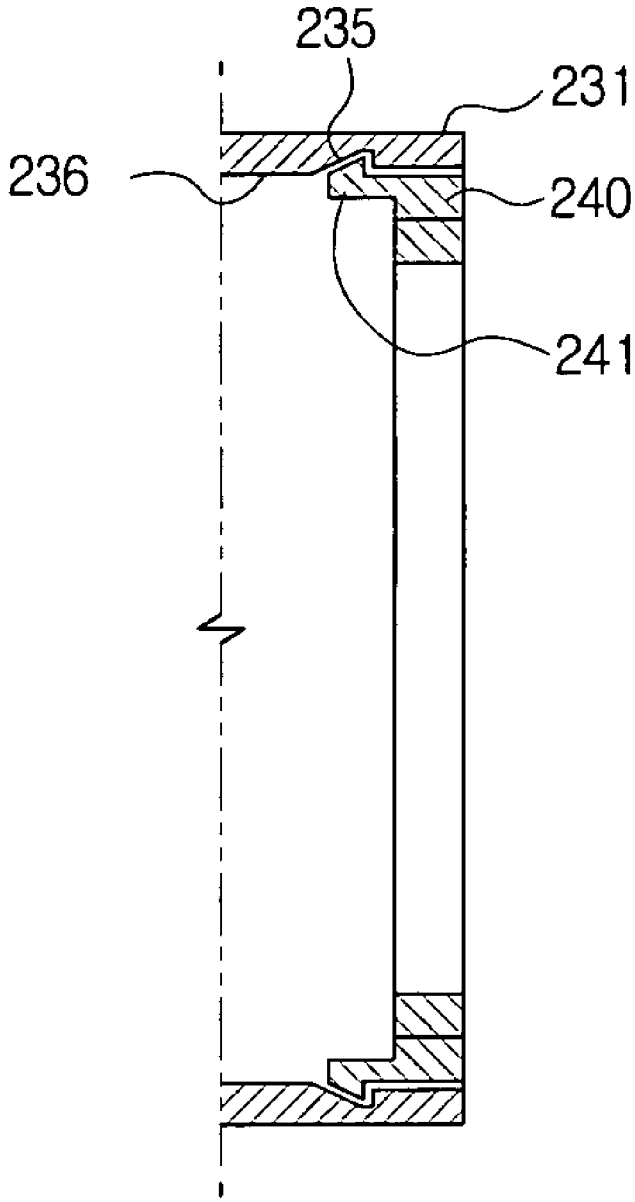
FIG. 4 is a sectional view of main elements in a state an inertia member of FIG. 3 is mounted in the driving unit.

As shown in FIGS. 3 and 4, the inertia member 240 is mounted to the turbine 231 for the driving unit 230 to add inertia to a driving force for operating the brush member 220.

In other words, the inertia member 240 is implemented by a mass which rotates together with the turbine 231 for increasing the inertia by adding mass to the rotative force of the turbine 231. To this end, the inertia member 240 comprises a hook 241 for engagement with a hook hole 235 formed on an inner circumference 236 of the turbine 231.

More preferably, the inertia member 240 is formed as a ring in a corresponding shape to the inner circumference 236 of the turbine 231 and fixed in tight contact with opposite sides of the inner circumference 236 of the turbine 231 by the hook 241.

In the present embodiment, the inertia member 240 is fixed to the inner circumference 236 of the turbine 231 by the hook 241; however, the present invention is not limited to this structure. The inertia member 240 may be attached by a dedicated fixing means such as adhesive or integrally formed with the turbine 231.

Hereinbelow, operational relationship between the vacuum cleaner 1 and the turbine brush 200 will be described with reference to FIGS. 1 through 4.

As shown in FIG. 1, as the operation switch 31 of the connection member 30 is turned on, with the turbine brush 200 disposed to face the surface being cleaned, a suction force is generated from a driving motor (not shown) mounted in the cleaner body 10. The external air is drawn into the turbine brush body 210 by the suction force, and accordingly, the driving unit 230 is operated.

The turbine 231 of the driving unit 230 is rotated together with the inertia member 240, and the rotative force of the turbine 231 is transmitted to the brush member 220 through the power transmitter 233. Therefore, the brush member 220 is rotated to scratch and beat the dust on the surface being cleaned, thereby separating the dust from the surface being cleaned.

The dust separated by the brush member 220 is drawn in by the suction force and, as passing through the suction path 213 and the connection member 30, collected in the dust collecting chamber in the cleaner body 10.

The turbine 231 is rotated with the inertia member 240 so that the inertia can be added to the turbine 231 and increase the rotative force.

Figure 5:
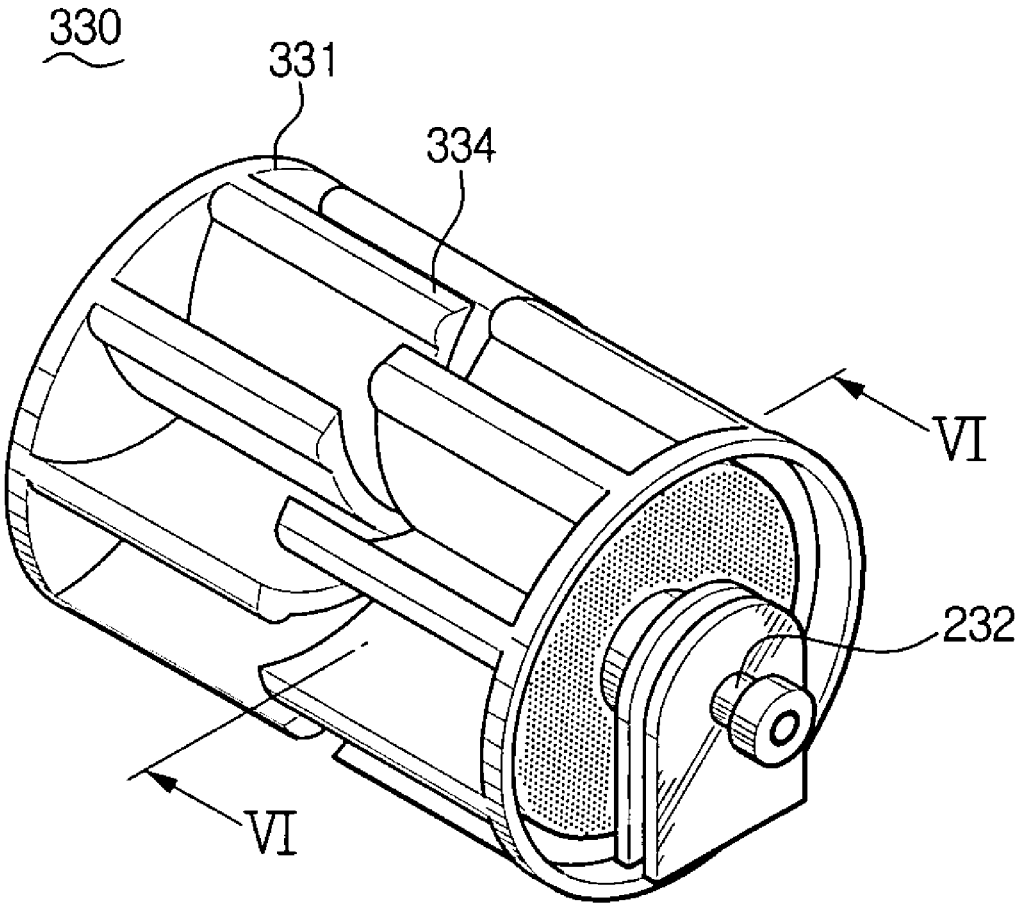
FIG. 5 is a perspective view of a turbine according to the second embodiment of the present invention.
Figure 6:
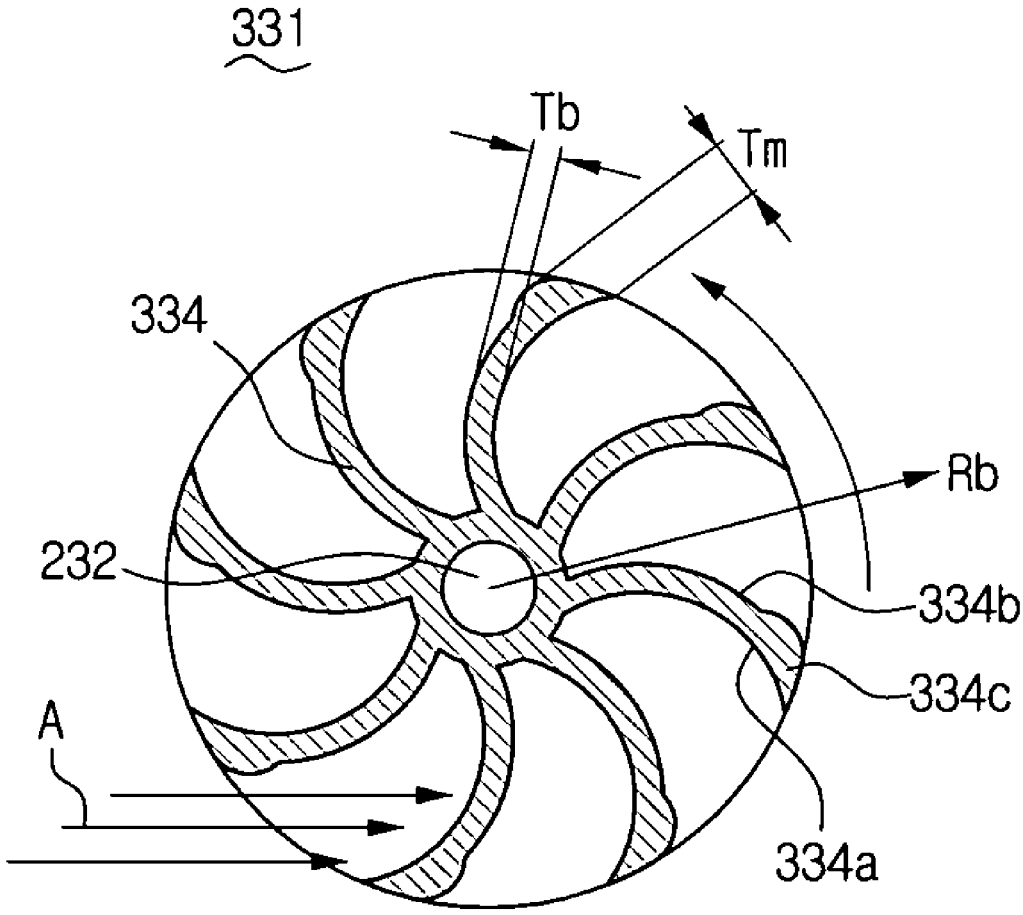
FIG. 6 is a sectional view of the turbine taken on VI-VI line of FIG. 5.

The turbine brush according to the second embodiment of the present invention comprises the turbine brush body 210 and the brush member 220 with the same structures as shown in FIG. 2 and the driving unit 330 with the same structures as shown in FIGS. 5 and 6.

The detailed descriptions and drawings of same structures as the aforementioned first embodiment will be omitted in the present second embodiment, and the following third and the fourth embodiments.

The driving unit 330 according to the second embodiment of the present invention comprises the turbine 331, the turbine shaft 232, and the power transmitter 233 (refer to FIG. 2). The technical constructions of the turbine shaft 232 and the power transmitter 233 are the same as described with reference to FIG. 2.

The turbine 331 is rotated by air drawn in through the suction path 213 and having a plurality of blades 334 with thickness-varying portions in a direction of radius Rb.

More specifically, arcs of the blades 334 of the turbine 331 are uneven in a spiral direction on opposite surfaces 334*b* to surfaces 334*a* encountering resistance of air A drawn in by a suction force.

The thickness Tm of a distal end 334*c* of the blade 334 may be greater than the other portion of the blade 334 due to the uneven arc. The distal end 334*c* of the blade 334 indicates the distal end 334*c* furthest from the turbine shaft 232 in the radius direction Rb.

The arc of the blade 334 is uneven at the distal end 334*c*, and therefore, the thickness Tm of the distal end 334*c* is greater than the thickness Tb of the blade 334. The distal end 334*c* of the blade 334 may be made of the same material as the blade 334 or may be made of material different from the blade 334.

As the thickness of blade 334 can be varied without requiring inertia member 240, and more weight can be added to the rotative force of the blade 334.

Figure 7:
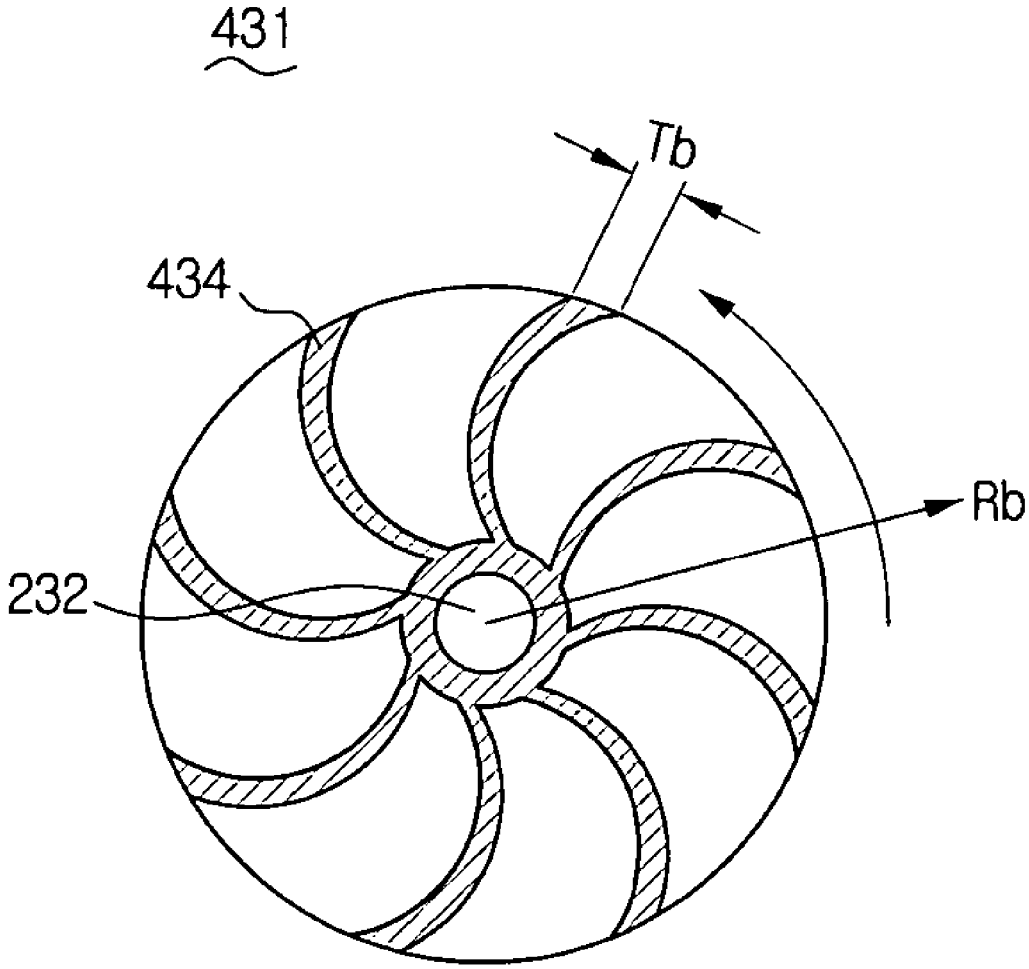
FIG. 7 is a sectional view of a turbine according to the third embodiment of the present invention.

Referring to FIG. 7, the turbine brush according to the third embodiment of the present invention is characterized of a turbine 431 having a plurality of blades 434 with increasing thickness Tb in the direction further away from the turbine shaft 232. The thickness Tb of the blade 434 increases in proportion to the length in the radius direction Rb. Therefore, more weight can be added to the blade 434 and increase the inertia.

Figure 8:
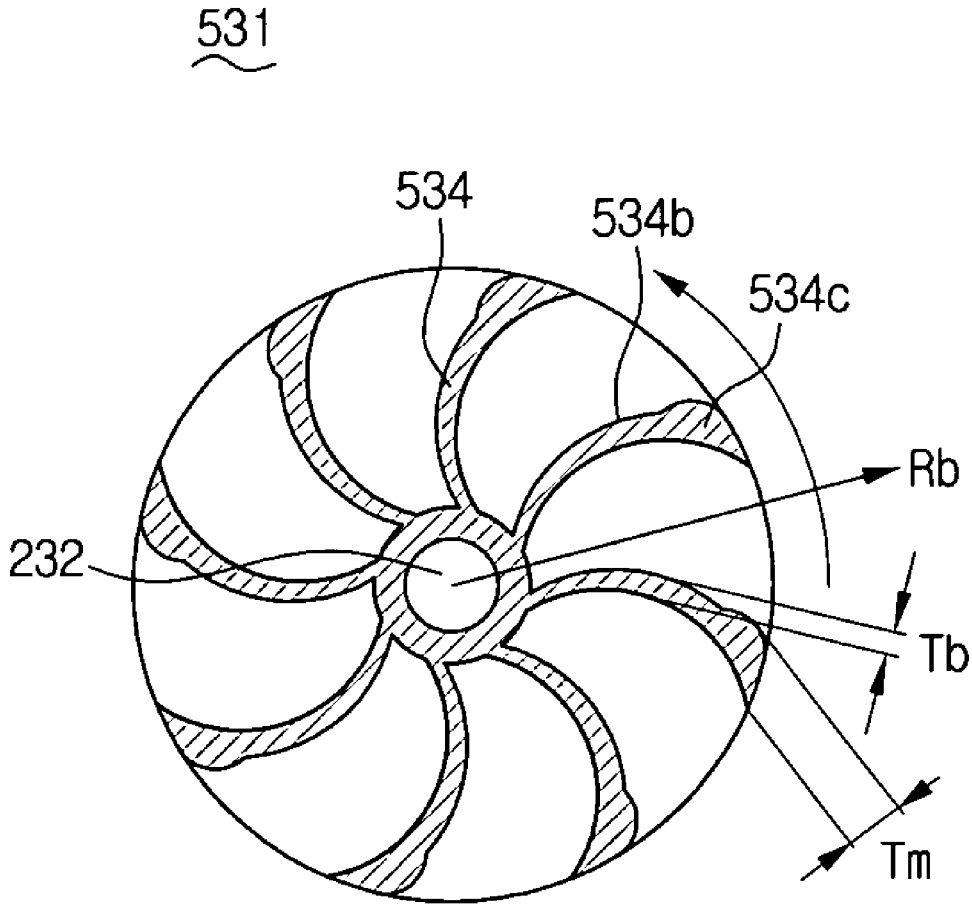
FIG. 8 is a sectional view of a turbine according to the fourth embodiment of the present invention.

Referring to FIG. 8, the turbine brush according to the fourth embodiment of the present invention is characterized of a turbine 531 having a plurality of blades 534 with increasing thickness Tb in a direction of the radius Rb and arcs of the blades 534 being uneven in a spiral direction on opposite surfaces 534*b* of the blades 534. The uneven arcs may preferably be formed at the distal ends 534*c* of the blades 534.

Therefore, all the distinguishable features of blades 334 and 434 according to the second and the third embodiments are applied to the blades 534 according to the present embodiment. Therefore, the blades 534 can effectively increase the rotative force.

According to the above structure, although small dusts such as hair is drawn in, owing to the inertia member 240 or blades 334, 434, 534 with varying thickness Tb in the radius direction Rb, inertia can be increased and therefore, the rotative force of the turbine 331, 431, 531 is not deteriorated.

If the turbine brush 200 is applied according to the embodiments of the present invention, the turbine 231, 331, 431 or 531 driving the brush member 220 rotates together with the inertia member 240, or has the blades 334, 434 or 534 with thickness-varying a portion in a direction of the radius Rb, such that a torque, that is the rotative force according to the centrifugal force of the turbine 231, 331, 431 or 531, can increase.

Accordingly, the rotative force is not affected by the small particles such as fine dust and hair. As a result, malfunction of the turbine brush 200 is prevented, thereby improving a cleaning efficiency.

While the invention has been shown and described with reference to certain embodiments thereof, it will be understood by those skilled in the art that various changes in form and details may be made therein without departing from the spirit and scope of the invention as defined by the appended claims.

What is claimed is:

1. A turbine brush for a vacuum cleaner, comprising:

a turbine brush body connected to a cleaner body in which a suction force is generated and having a suction path therein;

a brush member rotatably mounted to the turbine brush body;

a driving unit rotatably mounted in the turbine brush body to drive the brush member; and two inertia members mounted on opposite ends of the driving unit, respectively, wherein the driving unit comprises a turbine that has a cylindrical shape with opposite ends and is rotated by air drawn in through the suction path and the two inertia members are detachably mounted on the opposite ends of the turbine, respectively, of the driving unit, wherein when the turbine rotates, the two inertia members do not move with regard to the turbine, and wherein each inertia member comprises a hook for engagement with a hook hole formed on the opposite ends of the turbine.

2. The turbine brush of claim 1, wherein the driving unit comprises:

a turbine shaft disposed at a rotational center of the turbine; and a power transmitter for conveying a rotative force of the turbine to the brush member, wherein the turbine has a plurality of blades.

3. The turbine brush of claim 1, wherein the at least one inertia member is mounted to the turbine and rotated together with the turbine.

4. The turbine brush of claim 1, wherein the at least one inertia member has an annular shape and is fixed to the inner circumference of one end of the turbine.

5. The turbine brush of claim 2, wherein one or more of the plurality of blades has a thickness that increases in a radial direction.

6. The turbine brush of claim 5, wherein each of the plurality of blades is arc shaped and has first and second surfaces; wherein the first surface encounters the drawn-in air and the second surface has a raised portion at a distal end of the blade.

7. The turbine brush of claim 5, wherein the blade has a greater thickness at a distal end thereof than at a proximate end thereof.

8. The turbine brush of claim 5, wherein the thickness of the blade increases with distance from the rotational center.

9. The turbine brush of claim 8, wherein each of the plurality of blades is arc shaped and has first and second surfaces; wherein the first surface encounters the drawn-in air and the second surface has a raised portion at a distal end of the blade.

10. The turbine brush of claim 2, wherein the power transmitter includes a timing belt connecting the turbine shaft and the brush member to transmit power.

11. The turbine brush of claim 1, wherein the driving unit is disposed on the suction path in the turbine brush body.

12. A turbine brush for a vacuum cleaner, comprising:

a turbine brush body connected to a cleaner body in which a suction force is generated and having a suction path therein;

a brush member rotatably mounted to the turbine brush body; and a driving unit rotatably mounted in the turbine brush body to drive the brush member and having a first set of blades and a second set of blades mounted on opposite ends of the driving unit; and two inertia members detachably mounted on opposite ends of the driving unit, respectively, for adding inertia to a driving force of the driving unit;

wherein the first set of blades and the second set of blades are alternately positioned from each other, wherein the driving unit comprises a turbine that has a cylindrical shape with opposite ends and is rotated by air drawn in through the suction path and the two inertia members are detachably mounted on the opposite ends of the turbine, respectively, wherein when the turbine rotates, the two inertia members do not move with regard to the turbine, and wherein each inertia member comprises a hook for engagement with a hook hole formed on the opposite ends of the turbine.

* * * * *